US007789539B2

(12) United States Patent
Kauffman et al.

(10) Patent No.: US 7,789,539 B2
(45) Date of Patent: Sep. 7, 2010

(54) COMPACT FLOODLIGHT SYSTEM

(75) Inventors: Rick Kauffman, Buford, GA (US); Edward Bilson, Germantown, TN (US); Barbara Bilson, legal representative, Germantown, TN (US); Jason Cook, Laurel, MS (US)

(73) Assignee: Howard Industries, Inc., Laurel, MS (US)

( * ) Notice: Subject to any disclaimer, the term of this patent is extended or adjusted under 35 U.S.C. 154(b) by 41 days.

(21) Appl. No.: 12/284,351

(22) Filed: Sep. 19, 2008

(65) Prior Publication Data

US 2009/0116247 A1 May 7, 2009

Related U.S. Application Data

(60) Provisional application No. 60/994,907, filed on Sep. 21, 2007.

(51) Int. Cl.
*F21V 15/01* (2006.01)

(52) U.S. Cl. ..... 362/346; 362/362; 362/373; 362/217.01; 362/221

(58) Field of Classification Search ..... 362/217.01, 362/221, 346, 373, 362
See application file for complete search history.

(56) References Cited

U.S. PATENT DOCUMENTS

| | | | | |
|---|---|---|---|---|
| 5,829,866 | A | 11/1998 | Stegeman | |
| 7,547,117 | B1 * | 6/2009 | Russello et al. | 362/285 |
| 7,575,336 | B2 * | 8/2009 | Yoshida et al. | 362/147 |
| 7,597,450 | B2 * | 10/2009 | Garrett | 362/216 |

* cited by examiner

*Primary Examiner*—Anabel M Ton
(74) *Attorney, Agent, or Firm*—Hoffman & Baron, LLP

(57) ABSTRACT

A compact luminaire which includes a housing, a ballast, and a first and second electrical component. The housing has a back and a perimeter wall which extends generally perpendicularly from the back. The perimeter wall has a top wall portion, a bottom wall portion disposed in a downward direction with respect to the top wall portion and sidewall portions connecting the top wall portion and the bottom wall portion. The ballast is mounted to the back adjacent the bottom wall portion and is substantially equidistant to the side wall portions and the first and second electrical components are mounted to the housing on opposite sides of the ballast in a balanced fashion.

20 Claims, 4 Drawing Sheets

COMPACT FLOODLIGHT SYSTEM

CROSS-REFERENCE TO RELATED APPLICATION

This application claims priority from provisional application Ser. No. 60/994,907 filed on Sep. 21, 2007, which is incorporated herein by reference in its entirety, for all purposes.

BACKGROUND OF THE INVENTION

The present invention relates to luminaires for outdoor lighting, and more particularly, to a compact floodlight for multi-purpose uses.

Floodlighting is generally used outdoors to illuminate large open areas from a location on a perimeter of a site with the light directed inward to the site or from a location on the interior of the site and the light directed outward. These types of luminaires are sometimes called projectors since they project light across spaces usually several times the length of their mounting heights.

Typically floodlights consist of a cast aluminum housing, a cast aluminum door, control gear to operate a lamp, (usually a high intensity discharge lamp), an optical or reflector system to project the light in a desired distribution and direction, and a mounting means to attach it to a pole or the side of a structure.

Within the American National Standards Institute (ANSI) there is a committee, C136, which publishes standards defining some of the mechanical and electrical requirements for this type of lighting equipment. The relevant standards to this invention are: C136.2-2004 (American National Standard for Roadway and Area Lighting Equipment—Luminaire Voltage Classification), C136.10-2006 (American National Standard for Roadway and Area Lighting Equipment—Locking-type Photocontrol and Mating Devices—Physical and Electrical Interchangeability and Testing), and C136.32-2006 (American National Standard for Roadway and Area Lighting Equipment—Enclosed Setback Luminaires and Directional Floodlights for High-intensity Discharge Lamps).

The Illumination Engineering Society of North America (IESNA) also publishes a standard defining the classifications of light or beam patterns for a floodlight which are useful to lighting practitioners in properly applying this equipment. The relevant standard is RP-6-01, The Recommended Practice for Sports and Recreational Area Lighting.

In addition to meeting all of the above standards, luminaires having a compact size are often desirable in many lighting applications. Decreasing the overall size of the luminaire, however, leads to other problems relating to weight balancing, heat dissipation and internal accessibility. For example, when moving the internal components of the luminaire closer together in an attempt to decrease the overall size of the luminaire, consideration must be given as to the concentration of the weight of the components and the effects of certain heat generating components on other nearby components. It is also necessary to maintain an ease of accessibility to the internal components from the outside for periodic maintenance and repair. Accordingly, it would be desirable to provide a compact luminaire meeting all these requirements.

SUMMARY OF THE INVENTION

The present invention is a compact luminaire which includes a housing, a ballast, and a first and second electrical component. The housing has a back and a perimeter wall which extends generally perpendicularly from the back. The perimeter wall has a top wall portion, a bottom wall portion disposed in a downward direction with respect to the top wall portion and sidewall portions connecting the top wall portion and the bottom wall portion. The ballast is mounted to the back adjacent the bottom wall portion and is substantially equidistant to the side wall portions and the first and second electrical components are mounted to the housing on opposite sides of the ballast in a balanced fashion.

In a preferred embodiment, the ballast is also mounted to the bottom wall portion and is in thermal contact with the back and bottom wall portion of the housing for dissipating heat from the ballast to the housing. The back of the housing and the bottom wall portion both preferably include at least one raised landing integrally formed thereon, and the ballast is mounted to the landings. The ballast is preferably fastened to the landings with at least one mounting fastener, which is in thermal contact with the ballast and the landing which results in heat being conducted.

The luminaire also preferably has a door which is pivotably connected to the housing. The door includes a lampholder, capable of providing electrical power to a lamp, and a second reflector portion mounted to the door. The second reflector portion cooperates with a first reflector portion provided in the housing to form a complete, uniform reflective enclosure surrounding the lampholder when the door is in a closed position with respect to the housing. As a result, the lampholder is freely accessible from the outside when the door is pivoted in an open position for servicing and/or replacement.

The door further preferably includes a transparent or translucent lens through which light from the lamp is directed. The second reflector portion is preferably mounted to the door with brackets attached to the sides thereof to secure the reflector portion and the lens to the door, thereby serving a dual purpose. Also, the luminaire housing preferably includes at least one recess formed in a side wall portion of its perimeter wall for receiving the lampholder when the door is in a closed position. A gasket is preferably supported on the top of a perimeter sidewall of the housing for providing a seal between the door and the housing.

A preferred form of the compact luminaire, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

Figure 1:
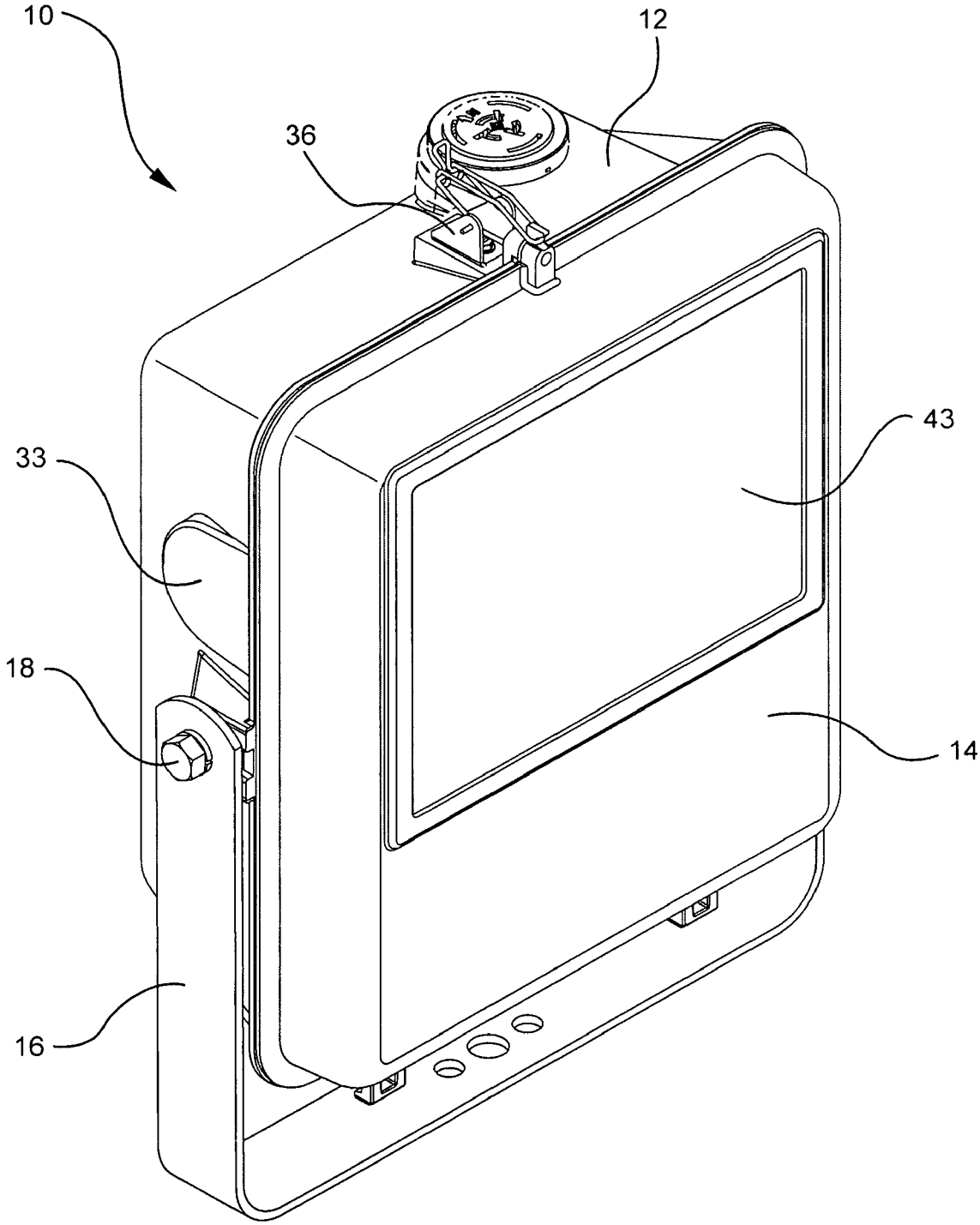
FIG. 1 is a front view of the compact floodlight according to the present invention showing its overall dimensions.

Referring to the drawings, a floodlight luminaire 10 of the present invention generally includes a luminaire housing 12, a door 14 hinged to the housing and a mounting means 16 for mounting the luminaire to a structure. As shown in FIG. 1, the luminaire 10 of the present invention has a square compact design. In a preferred embodiment, the height of the luminaire is about 15.7 inches and the width is about 13.9 inches.

Figure 2:
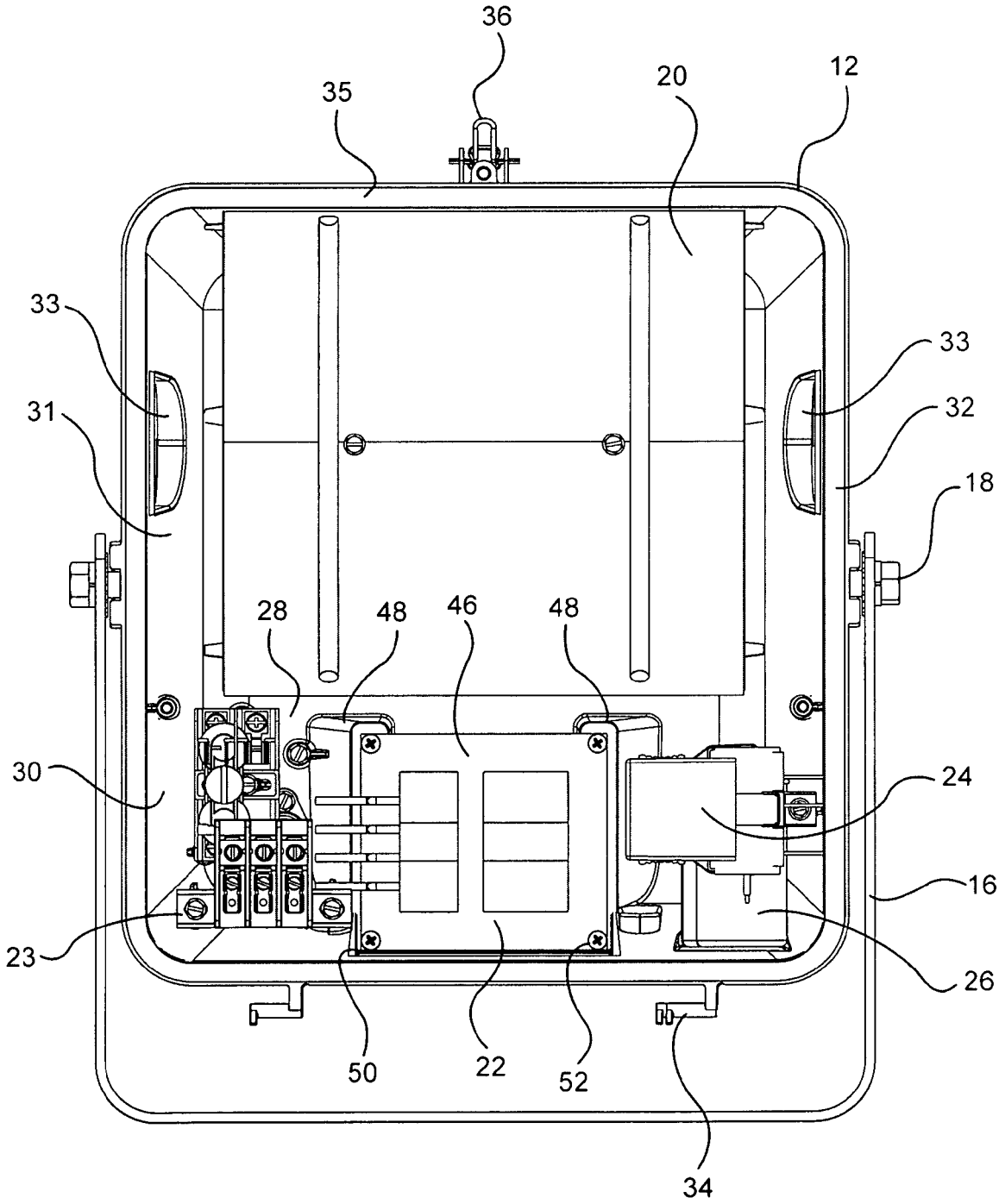
FIG. 2 is a front view of the compact floodlight shown in FIG. 1, with the door removed showing the first reflector portion, the ballast and other component placement.

The luminaire 10 shown in FIGS. 1 and 2 includes a yoke or trunnion mounting means 16 pivotably connected to the housing 12. Such connection can be achieved with bolts 18, which enable the housing 12 to rotate freely 360 degrees about the luminaire to provide maximum freedom for vertically aiming the luminaire. Once the desired illumination angle is achieved, the bolts 18 can be tightened to maintain the housing 12 in the desired position. Alternate mounting means, such as a mini-yoke or swivel-tenon can be attached to the bottom outside of the housing 12.

FIG. 2 shows the compact placement of the various components of the housing 12. In general, the housing 12 is defined by a back 28 and a perimeter side wall 30 extending generally perpendicularly outwardly from the back. The perimeter side wall 30 is defined by a top wall portion 35, a bottom wall portion 38 disposed opposite the top wall portion in a downward direction, and side wall portions 31 connecting the top and bottom wall portions. The back 28 and perimeter wall 30 thus form a housing interior.

Contained within the housing interior is a first reflector portion 20, a ballast 22, and various other electrical components, such as a terminal block 23, a starter 24 and a capacitor 26, all mounted to the back 28 of the housing within the perimeter side wall 30 of the housing. The housing 12 further preferably includes a gasket 32 supported on top of the perimeter sidewall 30 for providing a seal between the door 14 and the housing. The housing 12 further preferably includes one or more hinge members 34 and a latch member 36 to respectively hingedly couple and latch the door 14 to the housing 12.

The ballast 22 is the heaviest component of the system. Therefore, mounting the ballast in the center of the housing back 28, equidistant between the side walls 31, with the other electrical components surrounding the ballast in a balanced fashion serves to balance the luminaire weight. Mounting the ballast 22 against the bottom-most wall 38 of the housing perimeter wall 30 also lowers the center of gravity and reduces bending moment stresses on the mounting means 16.

Figure 3:
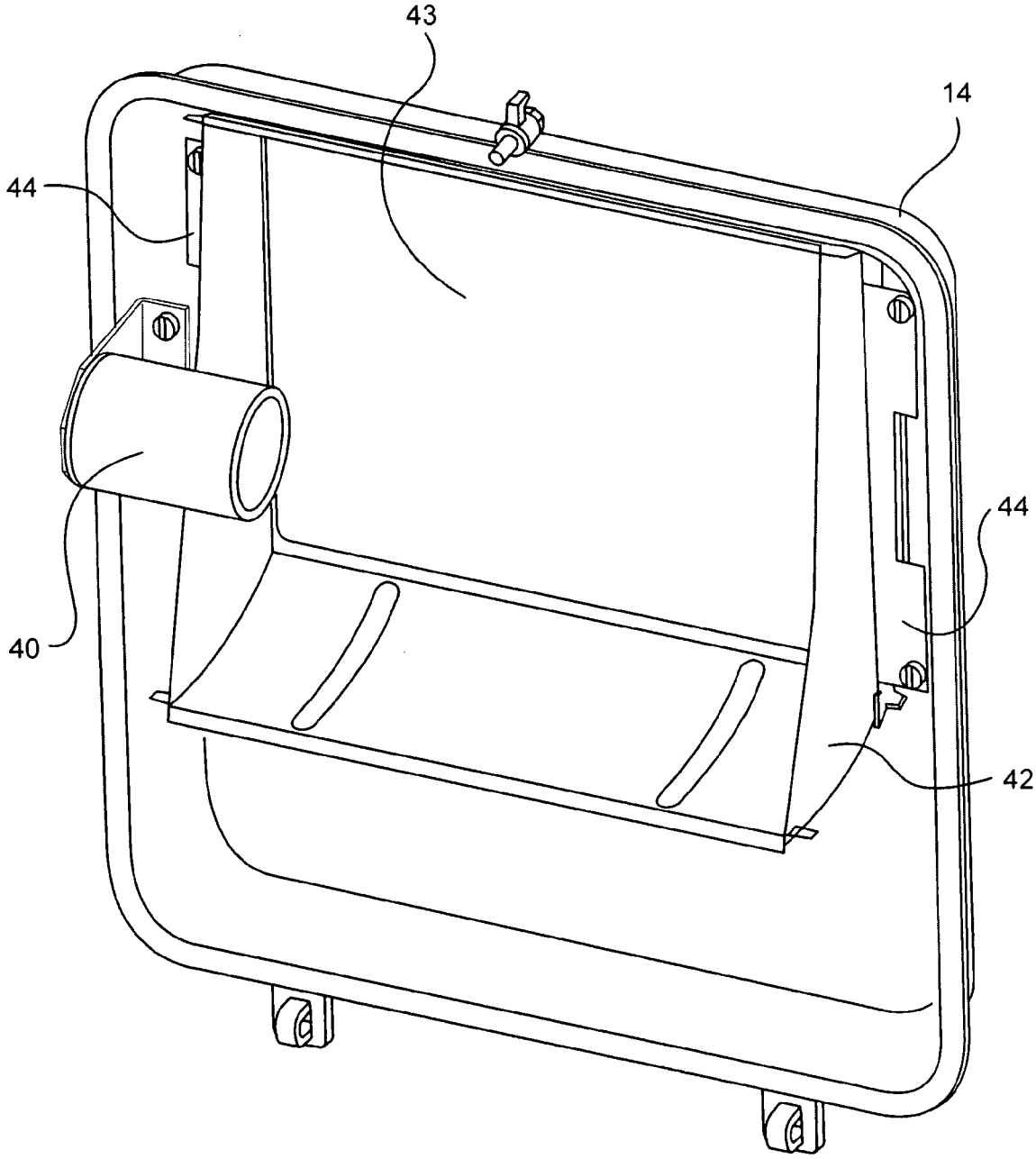
FIG. 3 is a perspective view of the inside of the door showing the second reflector portion and the lamp attachment.

FIG. 3 shows the luminaire door 14 of the present invention. The door 14 includes a lampholder 40, for receiving and providing electrical power to a lamp, and a second reflector portion 42 mounted thereto. The door 14 further preferably includes a transparent or translucent lens 43 through which light from the lamp (not shown) is directed. By mounting the lampholder 40 to the door 14, as opposed to the luminaire housing 12, the lamp is more easily accessible when the door is opened for servicing and/or replacement.

To further decrease the size of the luminaire, the housing 12 includes recesses 33 formed in opposite sidewall portions 31 of the perimeter wall 30. The recesses 33 are sized and positioned to receive at least a portion of the lampholder 40 when the door 14 is pivoted into its closed position. In this manner, the sidewall portions 31 of the perimeter wall 30 can be brought closer together, thereby reducing the overall width of the housing 12.

Also, the second reflector portion 42 complements the first reflector portion 20 provided in the housing 12 to form a complete, uniform reflective structure when the door 14 is secured to the housing 12 in a closed position. The second reflector portion 42 is provided with brackets 44 that are attached to the sides thereof to secure the reflector portion and the lens 43 to the door, thereby serving a dual purpose.

Figure 4:
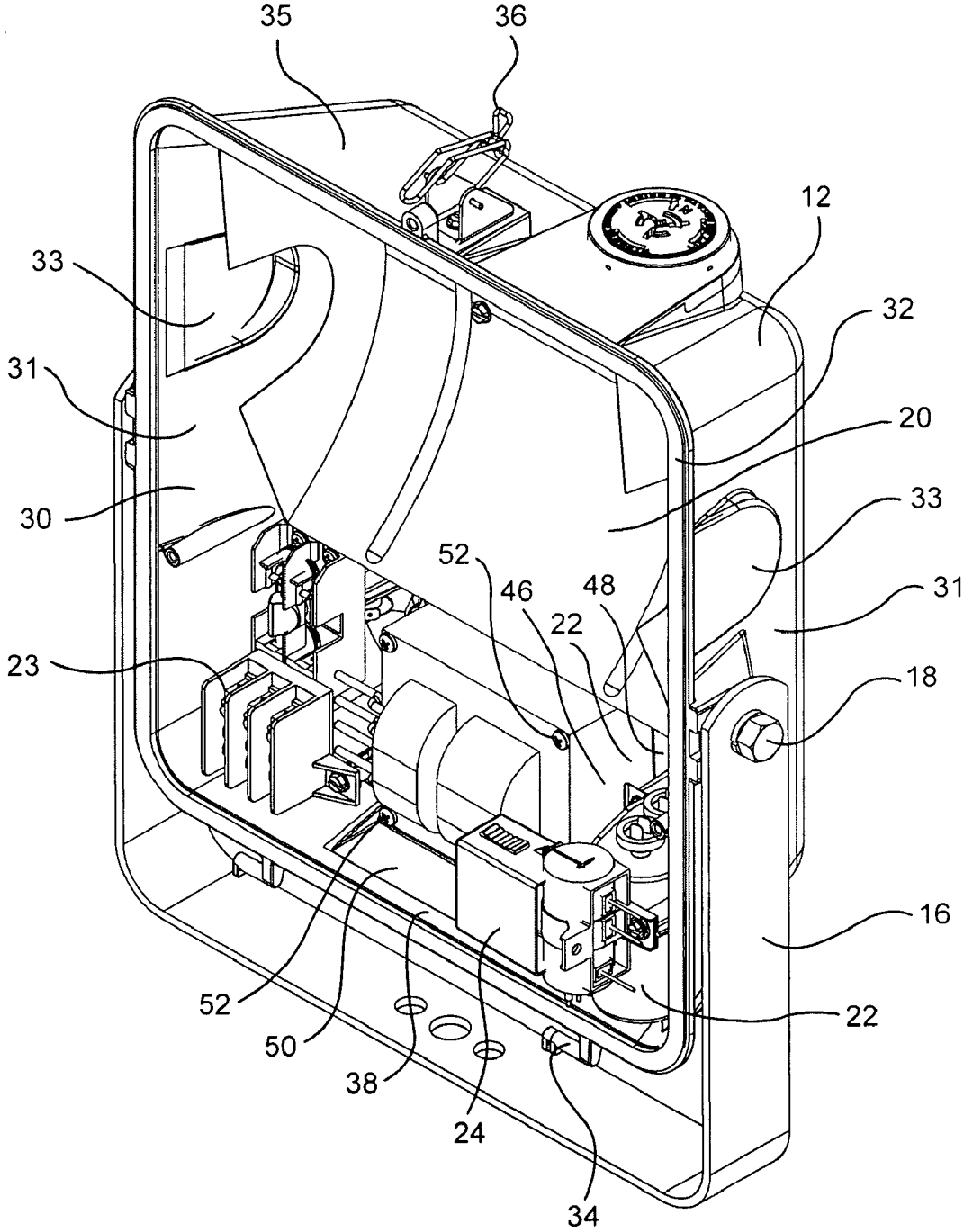
FIG. 4 is a close-up view of the ballast area showing the unique mounting and heat-sinking features.

The lamp and the ballast 22 are the two primary heat generating components of the luminaire 10. While the reflector system directs most of the lamp heat out of the luminaire 10, the ballast heat must be conveyed via convection through the air inside the luminaire and conducted through the housing 12. FIG. 4 shows the dual means of conducting heat away from the ballast 22. First, heat is transferred by contact of the face of the ballast laminations 46 on a pair of landings 48 formed on the back 28 of the housing 12. Second, heat is further transferred from the ballast laminations 46 via thermal contact with the bottom wall 38 of the housing 12. In this regard, the bottom wall 38 is preferably provided with a built-up landing 50 to serve as a heat sink. Heat is also transferred by the four screws 52 going through the laminations 46 for securing the ballast to the landing 48 on the back 28 of the housing.

As a result of the present invention, a floodlight luminaire for general area site lighting is provided, which incorporates a high intensity discharge lamp system in a very small housing and meets industry requirements. The luminaire utilizes a unique ballast mounting method so as to extract heat from two directions simultaneously and to operate the ballast in a smaller space below maximum allowable temperatures. In this regard, the ballast is further preferably mounted in the bottom center of the housing so as to balance the unit and lower the center of gravity. The floodlight luminaire of the present invention further includes a lamp and a lampholder attached to the door of the luminaire so as to facilitate re-lamping.

The present invention is a luminaire assembly of the smallest possible size to house all of the necessary components in the proper configuration to meet industry requirements. In particular, the largest being a 400 watt metal halide lamp with an ED-37 or BT-37 envelope as defined in ANSI C78.43-2004 (American National Standard for Electric Lamps—Single-ended Metal Halide Lamps) along with its necessary ballast, capacitor, lampholder, reflector, terminal block, wiring and mounting means. The invention has the shortest height, width and depth of any similar product on the market. It utilizes a unique means of mounting the ballast to operate it at lower temperatures than in other versions of this product currently on the market. The ballast is mounted at the bottom center of the luminaire to give it greater balance and a lower center of gravity with respect to its mounting means.

Further, the lamp is mounted to the door such that it swings outward during servicing for easier re-lamping. The reflector is divided into two portions, one mounting in the housing and one mounting to the door and has superior photometric performance to similar products currently on the market. The portion of the reflector mounting to the door also serves as a means to hold the lens in place.

Although illustrative embodiments of the present invention have been described herein with reference to the accompanying drawings, it is to be understood that the invention is not limited to those precise embodiments, and that various other changes and modifications may be effected by one skilled in the art without departing from the scope or spirit of the invention.

What is claimed is:

1. A luminaire comprising:

a housing having a back and a perimeter wall extending generally perpendicularly from said back, said perimeter wall having a top wall portion, a bottom wall portion disposed in a downward direction with respect to said top wall portion and sidewall portions connecting said top wall portion and said bottom wall portion;

a mounting means connected to said housing for mounting the luminaire to a structure;

a ballast mounted to said back adjacent said bottom wall portion, said ballast being substantially equidistant to said side wall portions such that said ballast is centered with respect to said mounting means;

at least one first electrical component mounted to said housing on a first side of said ballast; and at least one second electrical component mounted to said housing on a second side of said ballast opposite said first side, wherein said first and second electrical components are mounted on said first and second sides of said ballast in a weight-balanced fashion.

2. A luminaire as defined in claim 1, wherein said ballast is also mounted to said bottom wall portion of said housing.

3. A luminaire as defined in claim 2, wherein said ballast is in thermal contact with said back and said bottom wall portion of said housing for dissipating heat from said ballast to said housing.

4. A luminaire as defined in claim 3, wherein said back of said housing includes at least one raised landing integrally formed thereon, said ballast being mounted to said landing, wherein said landing is a heat sink for conducting heat away from said ballast.

5. A luminaire as defined in claim 3, wherein said bottom wall portion includes at least one raised landing integrally formed thereon, said ballast being mounted to said landing, wherein said landing is a heat sink for conducting heat away from said ballast.

6. A luminaire as defined in claim 4, wherein said bottom wall portion includes at least one raised landing integrally formed thereon, said ballast being mounted to said landing on said bottom wall portion and said back of said housing, wherein said landings are heat sinks for conducting heat away from said ballast.

7. A luminaire as defined in claim 4, further comprising at least one mounting fastener connecting said ballast to said landing, said mounting fastener being in thermal contact with said ballast and said landing for conducting heat therebetween.

8. A luminaire as defined in claim 1, wherein said housing further includes a first reflector portion mounted on said back between said ballast and said top wall portion, and said luminaire further comprises a door pivotably connected to said housing, said door including a lampholder capable of providing electrical power to a lamp, and a second reflector portion mounted to said door, said second reflector portion cooperating with said first reflector portion to form a complete, uniform reflective enclosure surrounding said lampholder when said door is in a closed position with respect to said housing, said lampholder being freely accessible when the door is pivoted in an open position for servicing and/or replacement.

9. A luminaire as defined in claim 8, wherein said door further includes a transparent or translucent lens and a bracket attached to opposite sides of said second reflector portion to secure the second reflector portion and said lens to the door, thereby serving a dual purpose.

10. A luminaire as defined in claim 8, wherein said housing includes a recess formed in said perimeter wall therein for receiving said lampholder when said door is in said closed position.

11. A luminaire for general area site lighting comprising:

a luminaire housing having a back and a first reflector portion mounted on said back; and a door pivotably connected to said housing, said door including a lampholder capable of providing electrical power to a lamp, and a second reflector portion mounted to said door, said second reflector portion cooperating with said first reflector portion to form a complete, uniform reflective enclosure surrounding said lampholder when said door is in a closed position with respect to said housing, said lampholder being freely accessible when the door is pivoted in an open position for servicing and/or replacement.

12. A luminaire as defined in claim 11, wherein said door further includes a transparent or translucent lens and a bracket attached to opposite sides of said second reflector portion to secure the second reflector portion and said lens to the door, thereby serving a dual purpose.

13. A luminaire as defined in claim 11, wherein said housing includes a recess formed in a perimeter wall of said housing for receiving said lampholder when said door is in said closed position.

14. A luminaire as defined in claim 11, wherein said housing further includes a perimeter wall extending generally perpendicularly from said back, said perimeter wall having a top wall portion, a bottom wall portion disposed in a downward direction with respect to said top wall portion and sidewall portions connecting said top wall portion and said bottom wall portion, and said luminaire further comprises:

a ballast mounted to said back adjacent said bottom wall portion, said ballast being substantially equidistant to said side wall portions;

a first electrical component mounted to said housing on a first side of said ballast; and a second electrical component mounted to said housing on a second side of said ballast opposite said first side.

15. A luminaire as defined in claim 14, wherein said ballast is also mounted to said bottom wall portion of said housing.

16. A luminaire as defined in claim 15, wherein said ballast is in thermal contact with the back and said bottom wall portion of said housing for dissipating heat from said ballast to said housing.

17. A luminaire as defined in claim 16, wherein said back of said housing includes at least one raised landing integrally formed thereon, said ballast being mounted to said landing.

18. A luminaire as defined in claim 16, wherein said bottom wall portion includes at least one raised landing integrally formed thereon, said ballast being mounted to said landing.

19. A luminaire as defined in claim 17, wherein said bottom wall portion includes at least one raised landing integrally formed thereon, said ballast being mounted to said landing.

20. A luminaire as defined in claim 17, further comprising at least one mounting fastener connecting said ballast to said landing, said mounting fastener being in thermal contact with said ballast and said landing for conducting heat there between.

* * * * *